United States Patent [19]

Best

[11] 4,337,390

[45] Jun. 29, 1982

[54] ELECTRIC HEATING ELEMENT

[75] Inventor: Lorne A. Best, West Bloomfield, Mich.

[73] Assignee: National Element, Inc., Troy, Mich.

[21] Appl. No.: 227,434

[22] Filed: Jan. 22, 1981

[51] Int. Cl.[3] ..... H05B 3/06

[52] U.S. Cl. ..... 219/532; 174/138 J; 174/148; 174/149 R; 219/374; 219/375; 219/381; 219/537; 219/548; 219/550; 338/295; 338/299; 338/305; 338/319; 248/68 R; 373/119; 373/130

[58] Field of Search ..... 219/374, 375, 381, 415, 219/532, 369, 536, 537, 550, 548, 552; 174/138 J, 149 R, 152 G, 153 G, 148; 13/22, 25; 248/68 R; 338/213, 269, 204, 294, 305, 295, 316, 318, 319; 29/610

[56] References Cited

U.S. PATENT DOCUMENTS

| | | | |
|---|---|---|---|
| 454,207 | 6/1891 | Eickemeyer, Jr. | 338/299 |
| 716,048 | 12/1902 | Jenkins | 338/299 |
| 834,424 | 10/1906 | Waters | 338/295 |
| 933,989 | 9/1909 | Johnson | 219/375 |
| 1,335,483 | 3/1920 | Colby | 338/305 X |
| 1,602,804 | 10/1926 | Wilkinson et al. | 219/550 |
| 1,698,282 | 1/1929 | Simmons | 174/138 J |
| 1,726,476 | 8/1929 | Dunlop | 338/305 |
| 2,106,462 | 1/1938 | Lindberg | 219/415 |
| 2,155,289 | 4/1939 | Atkinson et al. | 338/299 |
| 2,513,945 | 7/1950 | Kitto et al. | 219/375 |
| 2,565,769 | 8/1951 | Halker | 219/369 |
| 3,212,045 | 10/1955 | Weyenberg | 338/316 |
| 3,373,239 | 3/1968 | Rubisch | 13/25 |
| 3,883,721 | 5/1975 | Paulson et al. | 219/532 |
| 4,011,395 | 3/1977 | Beck | 13/25 |
| 4,016,403 | 4/1977 | Best | 219/550 |
| 4,243,872 | 1/1981 | Best | 219/375 |

*Primary Examiner*—Volodymyr Y. Mayewsky
*Attorney, Agent, or Firm*—Cullen, Sloman, Cantor, Grauer, Scott & Rutherford

[57] ABSTRACT

An improved electrical heating element is constructed to increase the amount of electrical wire per unit space available for plug-type convection heating units. The heating element includes a metal frame structure with a plurality of spaced support elements and a plurality of spaced removable cross bars connected thereto. A plurality of ceramic heater support blocks, each of T-shape in plan, with spaced end faces are arranged end to end and have undercut grooves which receive a cross bar and are interposed between the support elements. A continuous electric resistance heating wire has a series of parallel spaced inverted U-shaped wire sections. The wire sections are arranged in groups. Each block has a support boss of reduced width adjacent one end face adapted to extend between the strands of a section of the heating wire. Each block has a pair of spaced bosses adjacent to its other end face which extend laterally outward of the support boss. Each wire section of a group is mounted upon a support boss of each block on one cross bar with the spacer bosses extending between and outward of adjacent sections. The one strands of adjacent sections are transversely interconnected below a row of support blocks mounted on an ajacent cross bar.

12 Claims, 11 Drawing Figures

FIG. 2
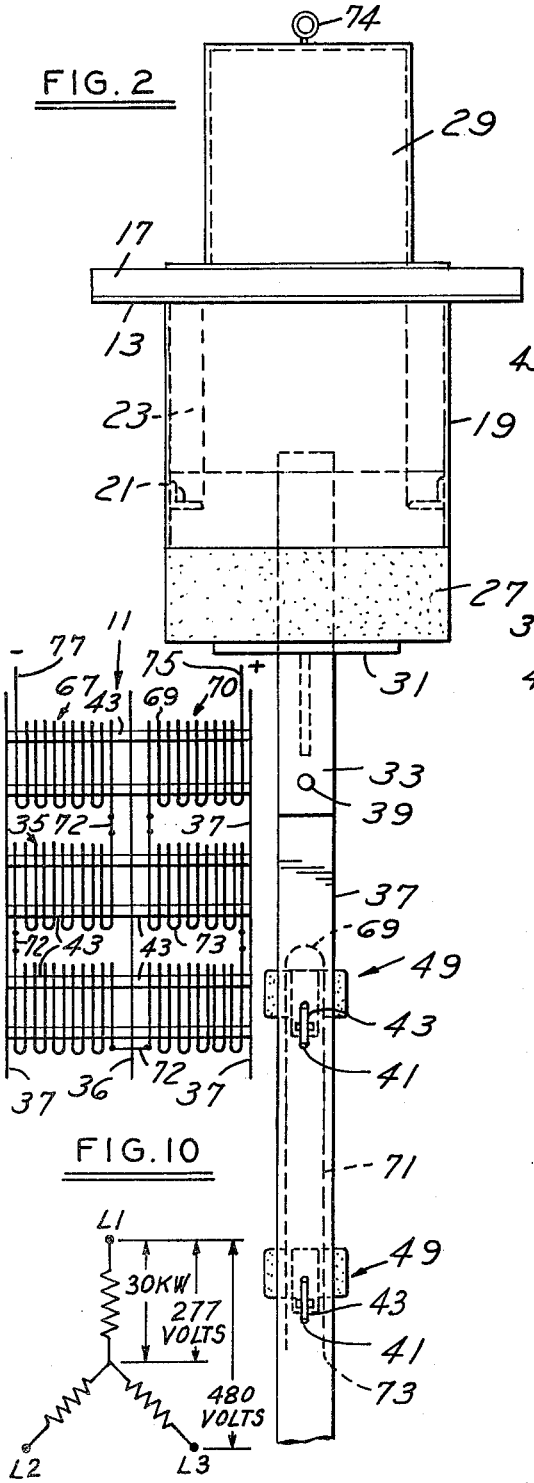
FIG. 3
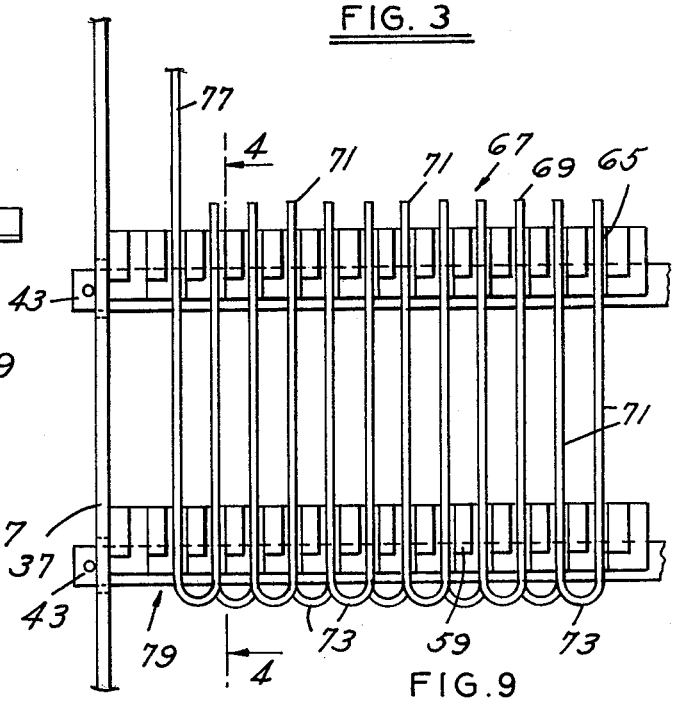
FIG. 9
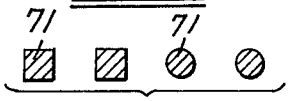
FIG. 4
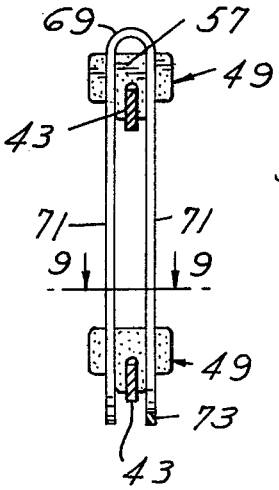
FIG. 5
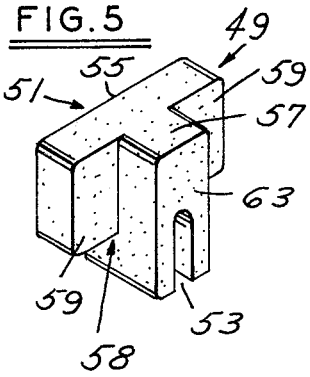
FIG. 10
FIG. 11
FIG. 6
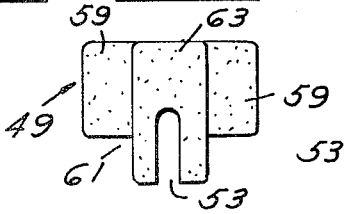
FIG. 7
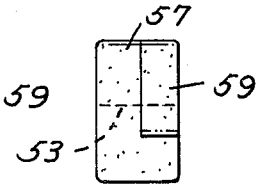
FIG. 8
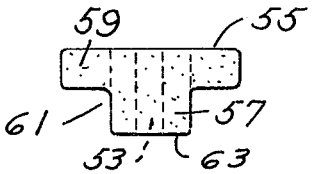

ELECTRIC HEATING ELEMENT

BACKGROUND OF THE INVENTION

The plug-type heating elements of the prior art consist of a series of metal rectangular sections which have an insulator on each side of each section at a plurality of spaced locations along the length of the section. The electrical heating wire is wound around each of the spacers down one side of the frame and back up the opposite side of the frame.

One problem with the prior art heating element construction involves the space taken up by each frame member which space interfers with the flow of air through the plug unit. In other words, the heating elements when electrically connected provide a source of heat with the flow of air passing through and around the heat elements determining the quantity of heat emitted from the plug unit. If air flow is restricted by metal frame sections, the kilowatt output per unit area will be decreased causing loss of efficiency. Likewise, the use of multiple frame sections for a plug unit occupies a large percentage of the physical space which could be used for heating elements.

Another problem of the prior art is that the insulators which are attached to the frame sections are difficult to remove and each insulator must be removed from the frame section separately in order to change wire spacing or otherwise repair the plug units. Additionally, the cost of construction necessitated by the multiple frame sections and the attachment of each individual insulator to the frame sections increases with the cost of materials for the frames and insulators as well as the labor involved in assembling a plug unit.

Other examples of prior art use of electrical resistive elements do not solve the problems associated with plug type convection heating. For example, the patent to Eickemeyer, Jr. (U.S. Pat. No. 454,207) discloses an electrical resistor box which uses a frame structure A with a pair of rods M mounted thereon. Additionally, a plurality of spacers D are positioned along the rods with coil resistance elements E wound around the spacers between the rods M. However, Eickemeyer does not address itself to plug type convection heaters and its design is merely to provide a fire safe means for operating an electric elevator.

The patent of Jenkins (U.S. Pat. No. 716,048) discloses an electrical resistance heater comprising a frame-like casing H and including a pair of rods I, I' mounted therein. A plurality of grooved insulators G are mounted on the rods to support a coil resistance element A therebetween. The Jenkins patent is used as an electrical heating element which is not related to plug type convection heaters and employs a core inside of the coil wound wire thereby cutting down on the air flow through the entire structure making the Jenkins heater inappropriate for the plug type convection heaters.

The patent to Wilkinson et al. (U.S. Pat. No. 1,602,804) which discloses an electrical resistance heater comprising a pair of rods 12 and 14 which are supported by walls 2 and has each rod supporting a plurality of grooved ceramic spacers 18 mounted thereon. A coil resistance element 22 is wound around the spacer 18 between the rods 12 and 14. The Wilkinson patent is not related to air flow convection type heaters and is primarily used as discussed in the patent in the form of electric toasters or other such appliances whose main object is radiated heat in a confined space.

Atkinson et al. (U.S. Pat. No. 2,155,289) discloses an electrical resistance heater comprising a frame 1 and 2 which supports a pair of rods 3. The rods, in turn, support a plurality of grooved ceramic spools 7. A coil resistance element 8 is wound around the ceramic spools between the rods 3. The heater of Atkinson is not set up in a manner so as to provide for a plug type convection heating system and additionally the wire is continuously wound in a coil-shaped manner throughout the entire structure. The main purpose of the heater of Atkinson is to provide a radiating type of electrical space heater as shown in FIG. 7.

The patent to Weyenberg (U.S. Pat. No. 3,212,045) discloses a grid resistor comprising a pair of frame members 1 separated by a pair of threaded rods 2. Metallic resistance elements 5 are spaced apart by a plurality of insulated spacers 9 and sleeves 13 mounted around the rods 2. The Weyenberg heater uses a metallic resistance element 5 which is unrelated to coiled resistance wires and furthermore the design features of the grid resistance show that it is not meant to be used as a convection type of plug heating unit because of the shape of the resistive metallic elements.

The patents to Best (U.S. Pat. No. 4,016,403), Beck (U.S. Pat. No. 4,011,395), Paulson et al. (U.S. Pat. No. 3,883,721), Dunlop (U.S. Pat. No. 1,726,476), Simmons (U.S. Pat. No. 1,698,282) and Colby (U.S. Pat. No. 1,335,483) generally show various types of open framework electrical resisting heating units which provide for adequate space heating but are not designed to alleviate the problems concerned with minimizing space to permit greater air flow thereby increasing the BTU output of plug type heater units.

The following patents are a further illustrative of the prior art:

| | |
|---|---|
| 834,424 | Waters |
| 933,989 | Johnson |
| 2,106,462 | Lindberg |
| 2,513,945 | Kitto |
| 2,565,769 | Hatker |

This invention is an improvement in the Electric Heating Element disclosed in my copending U.S. patent application Ser. No. 20594, filed Mar. 14, 1979, now U.S. Pat. No. 4,243,872, issued Jan. 6, 1981.

SUMMARY OF THE INVENTION

The present invention is an improved electrical heating element primarily for use in plug-type convection heaters. The heating element consists of a continuous electrical resistance heating wire having a series of groups of parallel inverted U-shaped sections. A frame support structure consisting of parallel spaced support elements has a plurality of spaced cross bars extending from the one side of the frame structure to the other side. The support elements and cross bars provide the boundaries for the continuous heating wire. A plurality of ceramic support spacer blocks are mounted end to end upon and along the cross bars with each of the blocks having a support boss for mounting a section of the heating wire. Each ceramic block includes a pair of spacer bosses which extend laterally of the support boss and between adjacent sections of the heating wire.

The heating element of the present invention, provides an improvement in the power density input and output to the plug-type heater. As many ceramic support blocks as practicable can be inserted between the sides of the frame thus eliminating air flow resistance, thereby permitting less pressure drop from one end of the frame to the other. This reduction in pressure drop allows the air flow to be more continuous and permits a greater output of heated air from the plug unit.

The present invention with its ceramic combination support and spacer blocks mounted on the cross bars allows for ease of assembly and repairability. The blocks may be simply lifted off the cross bar individually and without interference to adjacent blocks and without the removal of the cross bar.

The simplicity of construction and the ease with which the ceramic spacer support blocks are able to be changed permits the stacking of several rows of blocks without inhibiting the air flow.

The present invention also provides for reduced cost in the production of plug-type heaters since a time savings is achieved as there is no requirement of fastening each individual insulator support block to the cross bars of the frame structure.

Further the individual wire sections of the heating wire do not have to be tied to the insulating blocks as in my copending patent application.

A further feature includes as a part of the metal frame structure an intermediate support element parallel to the end support elements through which the respective cross bars extend in supported relation. The continuous heating wire is made up of a series of connected parallel spaced inverted U-shaped wire sections wherein the sections are arranged in groups. At least one group of connected wire sections is mounted at their one ends upon the respective ceramic support spacer blocks. Such group extends between the intermediate support element and one of the outer support elements. The lower ends of the wire elements of one group are laterally interconnected and extend around and are spaced by a second series of ceramic support blocks mounted upon an adjacent cross bar.

Another feature is specifically directed to the insulating combination ceramic support bar and spacer of unit construction which has a pair of spaced end faces and which has across its undersurface an elongated groove which extends between the end faces to facilitate removal and mounting of the blocks upon a cross bar. The block includes adjacent one end face a wire element support boss of reduced width adapted to extend between strands of a single inverted U-shaped section of the heating wire. The block includes a pair of spacer bosses which extend laterally outward of the support boss and extend between and outwardly of adjacent wire sections.

These and other objects and features will be seen from the following specification and claims in conjunction with the appended drawings.

BRIEF DESCRIPTION OF THE DRAWINGS

FIG. 2 is a fragmentary side elevational view taken in the direction of arrows 2—2 of FIG. 1.

FIG. 3 is a fragmentary side view of a portion of the frame structure upon the left side of FIG. 1 illustrating the mounting a part of one group of inverted U-shaped heater or wire sections.

FIG. 4 is a fragmentary section taken in the direction of arrows 4—4 of FIG. 3.

FIG. 5 is a perspective view of the present combination ceramic support and spacer block.

FIG. 6 is an end elevational view thereof.

FIG. 7 is a right side elevational view of the block shown in FIG. 6.

FIG. 8 is a plan view of the block shown in FIG. 6.

FIG. 9 is a fragmentary section taken in the direction of arrows 9—9 of FIG. 4 illustrating the heating wire on an enlarged scale as rectangular in cross section and also illustrating a modification showing the heater wire as circular in a cross section.

FIG. 10 is a schematic fragmentary side elevational view of the complete heating element showing a plurality of pairs of spaced cross bars for individually mounting a series of groups of interconnected heating elements adapted for connection to the power source shown schematically in FIG. 1.

FIG. 11 is a schematic wiring diagram of a 3 phase 108 amp. plug heater.

Figure 1:
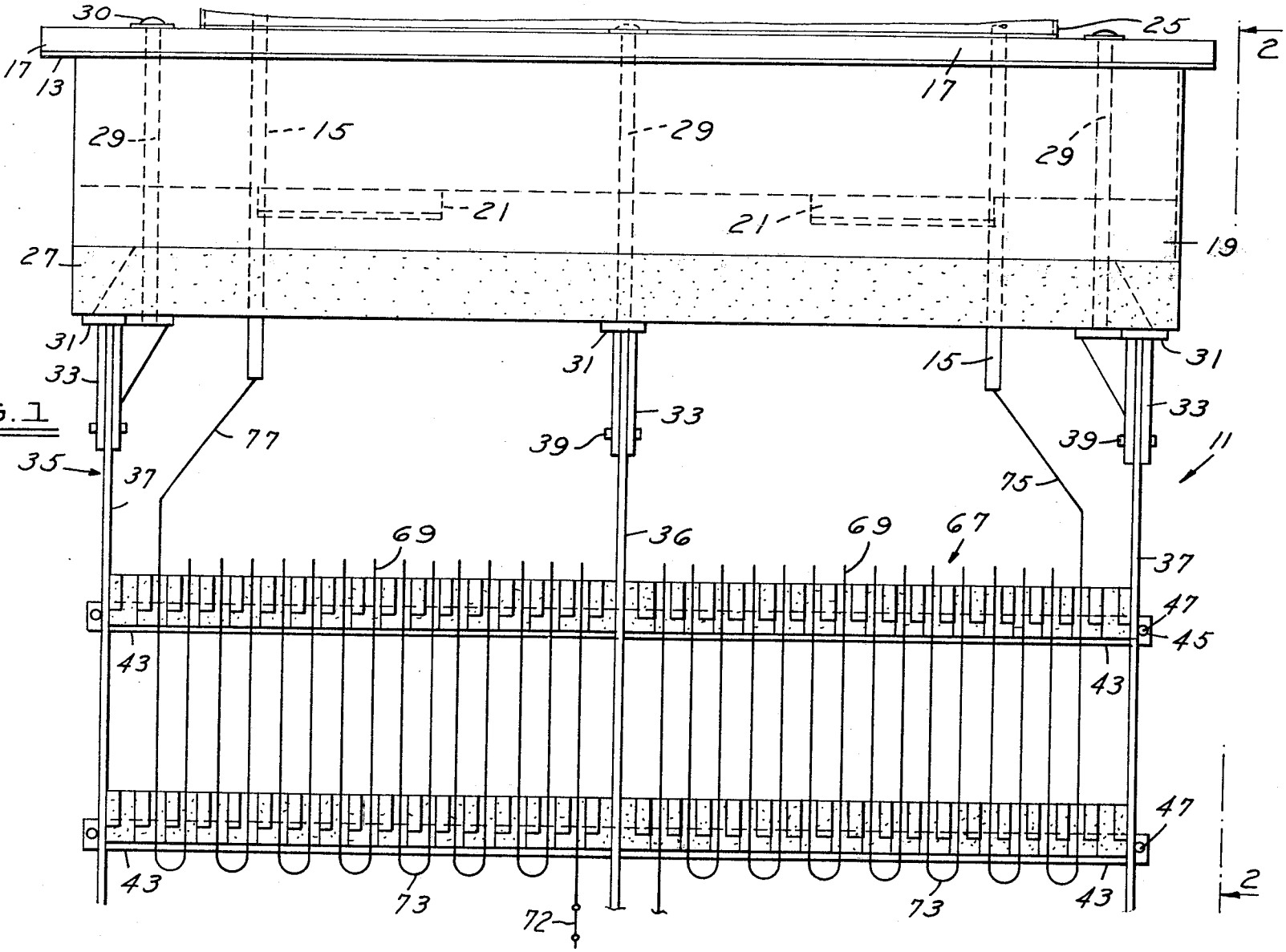
FIG. 1 is a fragmentary side view of the electric heating element of the present invention being a part of the electric heating element shown on a reduced scale in FIG. 10.

It would be understood that the above drawings illustrate merely a preferred embodiment of the invention and that other embodiments are contemplated within the scope of the claims hereafter set forth.

DETAILED DESCRIPTION OF AN EMBODIMENT OF THE INVENTION

Referring to the drawings, the present electrical heating element for a plug type convection heater is generally indicated at 11, FIGS. 1 and 10 and includes a steel support plate 13 mounting in an insulated relation a pair of terminals 15 which extend through an insulator plate 17 made from transite, for illustration, and into the elongated metal box 19 which underlies support plate 13.

The box 19 upon its interior has a plurality of angle brackets 21, FIG. 2, mounting block insulation or suitable brick lining 23. Terminals 15 at their upper ends, FIGS. 1 and 2, extend above insulator plate 17 and are enclosed within terminal box cover 25 which overlies and is secured to support plate 13. The terminals 15 are adapted, as an example, for connection to a suitable electrical power source up to 480 volts, such as for a 30 kilowatt plugheater, for illustration.

The terminals 15 extend through the exposed fire brick layer 27 underlying box 19 and connected to the respective end strands 75 and 77 of the continuous electric resistance heating wire 67.

A plurality of longitudinally spaced assembly racks 29, FIG. 1, include support plates 31 which underlie the exposed fire brick 27 and extend up through said fire brick, through the lined insulated metal box 19, through the elongated steel support plate 13, through the insulator plate 17 thereon and are suitably secured thereto as by fasteners 30. Each assembly rack 29 has depending from its support plate 31 a bifurcated bracket 33 for supportably mounting the frame 35 of the present heating element.

The frame or frame structure 35 is of generally rectangular shape constructed of metal and is open at its ends as shown in FIG. 10 and has a central longitudinal axis which generally coincides with the central support element 36 shown in FIG. 1.

The frame structure 35 besides the metal central support element 36 includes the pair of laterally spaced side support elements 37 of metal which define the longer sides of the rectangle, with each support element 36, 37 extending parallel to the axis.

The central support element 36 is arranged intermediate the outer or side support elements 37 of the frame 35 structure and extends parallel thereto. The upper ends of the respective support elements 36, 37 extend into the bifurcated brackets 33 and are secured thereto as by fasteners 39, FIG. 1.

Each of the support elements 36, 37 along its length have a series of longitudinally spaced apertures 41, FIG. 2 of rectangular shape. The apertures 41 receive end portions of the respective pairs of cross bars 43 which extend through all of the support elements 36, 37.

Each of the cross bars 43 adjacent its ends has a transverse aperture 45, FIG. 1 which receives the anchor pin 47 by which the respective cross bars 43 are removably mounted and secured with respect to support elements 36, 37.

While FIG. 1 illustratively shows a pair of cross bars 43 as making up part of the frame structure 35, the continuous heating wire is made up of a series of groups of upright parallel spaced inverted U shaped wire sections 69. For any particular group of wire sections 69, these are arranged between a pair of adjacent cross bars 43 supportably mounted by the upper of the cross bars, FIG. 4, and spaced and retained with respect to the lower of the cross bars, utilizing the present combination heater support and spacer blocks 49 made from ceramic, FIGS. 5–8.

Each of the support blocks 49 include a unit body 51 of a ceramic material having a pair of end faces 55 and 63 and upon the undersurface of said body an undercut slot 53 which extends between the end faces 55 and 63 and is adapted for mounting over a corresponding cross bar 43.

Each of the blocks adjacent end face 63 has a support boss 57 of reduced width with respect to end face 55, and is adapted to supportably mount one inverted U-shaped section 69 of the electric heating wire 67.

The body 49 includes adjacent end face 55 a pair of spacer bosses 59 which project laterally outward from opposite sides of the support boss 57 and extend between adjacent U-shaped sections 69 of the heating wire 67, FIGS. 3 and 4. The spacer bosses 59 adjacent end face 55 are of reduced height with respect to support boss 57 and define with the support boss 57 a clearance recess 58, FIG. 5 and below the spacer bosses 59, clearance recess 61, FIG. 6.

The respective insulating ceramic suppoert and spacer blocks 49 are mounted end to end in a line upon and along the cross bars 43 with the undercut recess 53 of the blocks 49 receiving the cross bars. The support blocks 49 extend end to end in one direction along the length of the respective cross bar between one side support element 37 and the central support element 36 and in the opposite direction between the central support element 36 and the other side support element 37 as shown in FIG. 1. In some applications the blocks 49 could face in the same direction along each cross bar 43. These provide a segmented insulated support for a group of heating or wire sections 69 such as shown in FIGS. 1, 3, 4 and 10.

The support blocks 49 are arranged end to end with the end face 63 of one block 49 bearing against an adjacent end face 55 of another block 49. This defines between adjacent pairs of spacer blocks 49 a series of upright clearance recesses 65, FIG. 3 between the respective support blocks 49. These recesses 65 loosely receive the corresponding strands 71 of each of the individual inverted U-shaped wire sections 69. These sections 69 are arranged in parallel spaced relation to a first plane. A plurality of the interconnected wire sections make up a unit group.

The one strands 71 of each U-shaped section 69, at their lower ends are joined by U-shaped connectors 73 of FIG. 3, with the connections between adjacent sections 69 being alternated between a pair of parallel planes through the strands 71 which extend at right angles to the plane of the individual U-shaped sections 69.

The respective end strands 75 and 77, FIG. 1 form a part of the continuous electric resistance heating wire 65, FIG. 1, or the corresponding end sections shown in FIG. 10. Here a plurality of groups of inverted U-shaped wire sections 69 are all interconnected with respect to a series of pairs of spaced cross bars 43. In both cases the end strands are connected to the corresponding 1. The heating wire 65 is made up of a series of spaced unit groups 70 of wire sections 69.

The groups 70, FIGS. 1 and 10 are suitably interconnected at their corresponding ends as by connectors 72, as by welding or other means.

The respective row of ceramic support blocks 49 is mounted upon a particular cross bar 43 extending between a pair of adjacent support elements 36, 37. Each row defines a segmented insulated support for the series of spaced inverted U-shaped wire sections 69 making a single group 70. In the present construction, should it be desirable to remove or replace one or more of the individual heater support and spacer blocks 49, this can be done without disconnecting the corresponding cross bars 43, by merely individually lifting out a particular support block 49 without interfering with any other support block. As shown in FIG. 9, the heating wire 71 may be rectangular in cross section in the illustrative embodiment. Alternately as further shown schematically it may be round in cross section.

An eye hook 74, FIG. 21, may be provided on the top panal of the terminal cover box 25 to permit the electrical heating element or plugheater 11 to be lifted by a suitable lifting device inserted through an opening provided in the top wall of the furnace and thereafter installed in the furnace as a drop-in roof mounted plugheater. Such plugheater, when repair or maintenance is required, may be removed through the top opening of the furnace by an overhead crane or other lifting device.

When the present invention is used as a drop-in roof mounted plugheater it includes a structure as described where the heating wire 67 is $\frac{1}{4}''$ square loaded at approximately 9 watts per square inch and rated at 30 KW, single phase. Three (3) heaters will make one star connected circuit FIG. 11 on each ten foot wall of the furnace. As an example, zone (1) of the furnace will be at 180 KW; zone (2) at 360° KW and zone (3) at 180 KW. All heaters are identical and can be exchanged while the furnace is at temperature. The heating element temperature on the surface of the $\frac{1}{4}''$ square inch will be approximately 1900° F. The block insulation of the furnace is at least 9 inches thick to support the aforesaid temperature. The electric heating element of plugheater is brick lined.

The one star connected circuit, FIG. 11, is controlled by a suitably calibrated thermocouple to connect to a fail safe instrument or alarm signal. This thermocouple must be mounted as close to the wire of the heating element as possible for the purpose of actuating the warning device indicating over temperature conditions. High limit set point is set at 100° F. over the maximum furnace temperature. The thermocouple will be used to control the electrical heating elements in the furnace.

Electrical grounding of the furnace is required. The plugheater units must be installed with a high temperature gasket between the heater support plate, steel box and the furnace support frame. Failure to instal a gasket may result in damage to the box, the top plate and/or wiring. Once an insulator block 49 is cracked, shipped or broken, it should be replaced in the novel manner indicated previously.

While in FIG. 10, six cross bars are shown, the 30 KW vertical plugheater described herein has a frame structure with three laterally spaced apart vertical support elements provided with ten cross bars. Each pair of adjacent cross bars have thirty-two insulating blocks 49 thereon and support one group 70 of heating or wire sections 69. There are a total of ten groups of wire sections in the electric heating element, for illustration. This number may be varied.

Having described my invention, reference should now be had to the following claims:

I claim:

1. An improved electrical heating element provided for an increased amount of electrical heating wire per unit space for plug-type convection heaters comprising;

an elongated generally rectangular-shaped metal frame structure open at its ends, having a longitudinal axis and having a pair of laterally spaced-apart support elements defining the longer sides of the rectangle, each support element extending parallel to said axis;

a plurality of spaced removable cross bars made from metal extending through said support elements from one side of the frame structure to the other side thereof in a direction generally perpendicular to said axis;

fastening means carried by said cross bars for removably connecting said cross bars to said support elements;

a plurality of ceramic support blocks, each of T-shape in plan, having spaced end faces and arranged end to end, mounted on and along the length of each cross bar and snugly interposed between said support elements;

a continuous electrical resistance heating wire having a series of parallel spaced inverted U-shaped sections;

each section having a pair of straight wire strands in a first plane;

each block having an undercut central groove extending between said end faces and snugly receiving said cross bars respectively, each support block having a support boss of reduced width adjacent one end face, extending between the strands of each section of the heating wire;

the engaging faces between adjacent blocks defining a clearance recess receiving the pairs of strands of each section of the heating wire;

each section of the heating wire being nested within a pair of said clearance recesses between blocks respectively and supportably mounted upon the respective support boss of each block upon one cross bar;

the one strands between adjacent sections being transversely interconnected below the row of support blocks mounted upon another cross bar.

2. The heating element of claim 1, the connections between the one strand of adjacent heater sections being U-shaped and lying in parallel planes at right angles to said first plane and being alternated between said parallel planes, said heating wire being nested and retained within the plane of said frame structure.

3. The heating element of claim 1 said heating wire being rectangular in cross section.

4. The heating element of claim 1, the support blocks being arranged in a row on each cross bar defining an elongated segmented insulated heater wire section support and spacer, any support block adapted to be lifted from its cross bar and individually replaced, without disturbing any other support block.

5. The heating element of claim 1, said support elements having a series of opposed longitudinally spaced apertures of rectangular shape receiving end portions of said cross bars, end portions of said cross bars having an aperture therethrough;

said fastening means including a anchor pin extending through said apertures respectively.

6. The heating element of claim 1, each support block having a pair of spacer bosses extending laterally of said support boss adjacent its other end face extending between and outwardly of adjacent heating wire sections, said support blocks being located at the upper and lower ends of each wire section.

7. The heating element of claim 6, the spacer bosses of each block being of reduced height relative to the adjacent support boss.

8. The heating element of claim 1, the end sections of said heating wire terminating in single strands adapted for connection to an electrical power source.

9. The heating element of claim 1, said frame structure having an additional support element intermediate and parallel to said pair of support elements, said cross bars extending through said intermediate support element said heating wire being arranged in spaced groups of heating wire sections, each group being interposed between said additional support element and one support element outwardly thereof.

10. The heating element of claim 1, said cross bars being arranged in pairs;

said heating wire being arranged in spaced goups of connected heating wire sections, with at least one group mounted on and spanning adjacent pairs of cross bars respectively.

11. The electrical heating element of claim 8 an elongated metal support plate overlying one end of said frame structure and projecting laterally thereof;

an elongated metal box underlying said support plate;

a fire brick lining on the interior of said box;

a layer of fire brick underlying said box;

a plurality of longitudinally spaced assembly racks, each having a support plate underlying said fire brick layer, each rack extending through said fire brick layer, through said box and projected through and secured to said elongated metal support plate, each support plate of said assembly racks having a depending bracket;

the upper end of said support elements being connected to said brakets respectively;

and a pair of terminals adapted for connection to an electrical power source mounted in insulated relation on and extending through said elongated metal support plate, through said box and through said fire brick layer, adapted for connection respectively to the single strands of the heating wire end sections.

12. The heating element of claim 9, each group of heating wire elements being of a unit construction and a connector between the end strands of one group and an adjacent group, the series of interconnected group making up said continuous heating wire.

* * * * *